US007914653B2

(12) United States Patent
Hashimoto et al.

(10) Patent No.: US 7,914,653 B2
(45) **Date of Patent: *Mar. 29, 2011**

(54) ANODE FOR ELECTROCHEMICAL REACTION

(75) Inventors: Koji Hashimoto, Miyagi-ken (JP); Ahmed Abd El-Moneim, Giza (EG); Naokazu Kumagai, Chiba-ken (JP)

(73) Assignees: Koji Hashimoto, Sendai (JP); Daiki Ataka Engineering Co., Ltd., Tokyo (JP)

( * ) Notice: Subject to any disclaimer, the term of this patent is extended or adjusted under 35 U.S.C. 154(b) by 574 days.

This patent is subject to a terminal disclaimer.

(21) Appl. No.: 11/976,511

(22) Filed: Oct. 25, 2007

(65) Prior Publication Data

US 2008/0149476 A1 Jun. 26, 2008

(51) Int. Cl.
*C25B 11/06* (2006.01)
*C25B 11/08* (2006.01)

(52) U.S. Cl. ..... 204/290.09; 204/290.08; 204/290.01; 204/290.03; 204/290.06; 204/291

(58) Field of Classification Search ..... 204/290.01, 204/290.03, 290.06, 290.08, 290.09, 290.14, 204/291

See application file for complete search history.

(56) References Cited

U.S. PATENT DOCUMENTS

| | | | | |
|---|---|---|---|---|
| 4,285,799 | A * | 8/1981 | de Nora et al. | 204/290.09 |
| 4,289,591 | A * | 9/1981 | Davidson et al. | 205/634 |
| 2008/0035491 | A1 * | 2/2008 | Ohta et al. | 205/551 |
| 2008/0116065 | A1 * | 5/2008 | Hashimoto et al. | 204/290.13 |

* cited by examiner

*Primary Examiner* — Bruce F Bell

(74) *Attorney, Agent, or Firm* — Edwards Angell Palmer & Dodge LLP

(57) ABSTRACT

Disclosed is an anode for electrochemical reactions, such as electrolysis and electrodeposition, comprising a titanium substrate covered with metal oxide, in which the amount of platinum group element(s) is decreased in comparison with the ordinary anode of platinum group element oxides so as to decrease the cost and to mitigate the problem of natural resources, and further, durability of the anode is improved. The electrocatalyst of the anode is multiple oxide of platinum group element(s), and Sn and Sb. The cationic ratio of Sn to Sb is 1-40 and the sum of Sn and Sb is 1-90 cationic %. The electrocatalyst is prepared by coating mixed solutions of the soluble salts on the substrate and baking, so as to convert the metal salts to metal oxides.

2 Claims, No Drawings

ANODE FOR ELECTROCHEMICAL REACTION

BACKGROUND OF THE INVENTION

1. Field in the Industry

The present invention concerns an anode with high activity, dimensional stability and no dissolution in prolonged operation in electrochemical reactions such as electrolysis and electrodeposition.

2. Prior Art

In general, titanium and other metals are used as the anode for electrolysis of solution of electrolytic substances and electrodeposition. Since the anode is polarized at high potentials and exposed to highly oxidizing condition, use of such metals is to utilize the characteristics of the metals that they form corrosion-resistant insulating film under such highly oxidizing condition.

However, the insulating surface film thus formed prevents the electron transfer through their surfaces which is the role of an electrode. In order to overcome this contradiction, titanium coated with oxides of an element or elements of the platinum group (hereinafter referred to as "platinum group element(s) ") resistant to highly oxidizing condition and having a high activity for the anode have been used.

For such electrodes, coherence of the electrocatalyst oxides of platinum group element(s) with the titanium substrate becomes effective if the electrocatalyst oxides have the same crystal structure as that of titanium oxide in addition to sufficient electric conductivity. Under such conditions the electrode will consist of a continuum of titanium substrate and electrocatalyst consisting of double oxide of titanium ion and electrocatalyst metal ion. The currently used dimensionally stable anodes are composed of the titanium substrate coated with oxides of the platinum group elements such as $RuO_2$, $RhO_2$, $PdO_2$, and $IrO_2$. These oxides have the same rutile structure as $TiO_2$ and their lattice constants are not largely different from those of $TiO_2$, with a consequent continuity from the titanium substrate to the electrocatalyst. Among these oxides $IrO_2$ is regarded to be the most suitable.

However, the wide use of the precious metal electrodes will result in consumption of a large amount of precious metals, and will lead to the lack of the resources. Thus, the highly active electrode with the use of small amounts of precious metals is desirable.

It is desirable for the coating substance on the titanium substrate to have the same rutile structure as $TiO_2$ and to be stable even under highly oxidizing condition. Tin oxide, $SnO_2$, has the same rutile structure as $TiO_2$ and is stable even in highly oxidizing environments. Thus, the inventors found use of $SnO_2$ together with precious metal oxides. Electric conductivity of $SnO_2$ is not high, and this is a difficulty in using. The inventors found that addition of Sb to Sn enhances electric conductivity of $SnO_2$.

SUMMARY OF THE INVENTION

The object of the present invention is, utilizing the above-mentioned knowledge, to provide a dimensionally stable anode with high performance and durability for electrochemical reactions such as electrolysis and electrodeposition, and to reduce consumption of the precious metals resulting in mitigation of the resource problems.

The above object is accomplished by the electrode made by coating the titanium substrate with multiple oxide of the platinum group element(s) as well as Sn and Sb.

More concretely, the anode of the present invention for electrochemical reactions consists of the titanium substrate coated with multiple oxide of the platinum group element(s), and Sn and Sb, in which the cationic ratio of Sn to Sb is 1-40 and the sum of Sn and Sb is 90 cationic % or less.

DETAILED EXPLANATION OF THE PREFERRED EMBODIMENTS

An example of preparation of the electrode according to the present invention is now described. Corrosion resistant titanium is suitable for the conducting substrate of the electrode which is exposed to highly oxidizing environment. The substrate is subjected to treatments for removal of the air-formed oxide film and surface roughening to enhance adhesion of the electrocatalyst thereto. The titanium substrate is coated by repeated brushing of the solution such as butanol solution of adequate concentrations of salts of the platinum group element(s), and salts of Sn and Sb, and subsequent drying and calcinations at 550° C. By these procedures, the electrode with the electrocatalyst of multiple oxide consisting of oxides of Sn and Sb as well as one or more of the platinum group element(s) is prepared.

The reasons why the composition of the cations in electrocatalysts are defined as above are explained below. The platinum group element(s) are the basic elements of the electrocatalysts of the present invention, and Ru, Rh, Pd, Os, Ir and Pt form $MP_2$ type oxides. These oxides, except for $PtO_2$, have the same rutile structure as $TiO_2$ and $SnO_2$, and form solid solutions therewith. The lattice constants in "a"-axis and "b"-axis of $PtO_2$ are quite close to those of $TiO_2$ and $SnO_2$, and hence, $PtO_2$ forms a single phase oxide with $TiO_2$ and $SnO_2$.

In this manner, the oxides of [platinum group element(s) with Sn and Sb], which act as the electrocatalysts in the present invention, form single phase multiple oxide, and hence, for the formation of crystal structure of the single phase multiple oxide the compositions can vary freely. From the view point of reducing the manufacturing costs of the electrode and saving the resources, it is advantageous to choose such a composition that the amounts of Sn and Sb are as high as possible relative to the amount of the platinum group element(s).

However, excess addition of [Sn and Sb] decreases performance of the electrodes in comparison with conventional platinum oxide electrodes, and hence, the sum of [Sn and Sb] in the electrocatalyst oxide should be 90 cationic % or less. On the other hand, if the sum of [Sn and Sb] in the electrocatalyst oxide is less than 1 cationic %, the electrode is not superior to the conventional platinum oxide electrodes, and hence, the sum of [Sn and Sb] in the electrocatalyst oxide should be 1 cationic % or more. Thus, suitable sum of [Sn and Sb] is in the range of 1-70 cationic %, and the most suitable sum of [Sn and Sb] is in the range of 30-60 cationic %.

Sb is added for the purpose of enhancing the electric conductivity of the electrocatalyst that is insufficient in the multiple oxide consisting of only platinum group element(s) and Sb. If Sn is contained in such an amount that the cationic Sn/Sb ratio is 40 or higher, the oxides formed have sufficient electric conductivity, and hence the Sn/Sb ratio should be 40 or higher. However, excess addition of Sb rather decreases the electric conductivity of the multiple oxide, and hence, addition of Sb must be at such level that the cationic Sn/Sb ratio is unity or less.

The electrodes of the present invention, when used for electrochemical reactions as the anodes for electrolysis or electrodeposition, exhibit high activity and are capable of maintaining the dimension even in a prolonged operation without being dissolved. Thus, in comparison with conventional oxide electrodes consisting of only platinum group element(s) or their oxide or oxides, necessary amount of the precious metal is lower, and the costs for producing are cheaper with mitigation of problem of resources.

EXAMPLES

Example 1

A titanium mesh substrate made by punching a titanium plate was immersed in 0.5 M HF solution for 5 min. to remove surface oxide film, and then subjected to etching in 11.5 M $H_2SO_4$ solution at 80° C. for the purpose of increasing the surface roughness until hydrogen evolution ceased. Titanium sulfate formed on the surface of the titanium mesh was washed away by flowing tap water for about 1 hr. Immediately before covering with the electrocatalysts the titanium mesh was ultrasonically rinsed with deionized water.

The titanium mesh with the effective surface area of 20 $cm^2$ was coated by brushing mixed butanol solutions of 4.0 ml of 5 M $K_2IrCl_6$, 5.33 ml of 5 M $SnCl_4$ and 0.67 ml of 5 M $SbCl_6$, dried at 90° C. for 5 min. and calcined for conversion to oxide at 550° C. for 10 min. This procedures were repeated until the weight of the oxide increased to about 45 $g/m^2$. The electrode was obtained by final calcination at 550° C. for 60 min. The cationic composition of the electrocatalyst thus formed was determined by EPMA. The cationic percentages of Ir, Sn and Sb were 65.6, 29.3 and 5.1, respectively. X-ray diffraction identified that the electrocatalyst of the electrode was the single phase triple oxide with the same rutile structure as $IrO_2$. For comparison, another electrode having electrocatalyst consisting of only $IrO_2$ 45 $g/m^2$ was prepared by similar procedures.

Using the electrode thus prepared as the anode, electrolysis was carried out in 3 M $H_2SO_4$ at 40° C. and at current density of 10,000 $A/m^2$, and the anode potential was measured. Oxygen overpotential of the anode of the present invention was about 0.6 V, and even after 2000 hour no increase in the overpotential was observed. When the comparative anode having electrocatalyst of only $IrO_2$ was used for the electrolysis at the current density of 10,000 $A/m^2$, the over potential was at about 0.6V for 450 h, and thereafter, suddenly increased showing the end of the life of the anode. It is, therefore, evident that the anode of the present invention has much longer durability as the oxygen evolution anode in the electrolysis of strong acid than the conventional dimensionally stable anode.

When the above-described anode of the present invention was used for chlorine evolution by electrolyzing 0.5 M NaCl solution at the current density of 10,000 $A/m^2$, the chlorine evolution efficiency was 87%.

Example 2

The same surface treatments as Example 1, such as removal of the surface film, etching for surface roughening, rinsing with water and ultrasonic rinsing were applied to the punched titanium substrate meshes of the effective surface area of 20 $cm^2$. Using the butanol solutions of different mixed ratios of 5 M $K_2IrCl_6$, 5 M $SnCl_4$ and 5 M $SbCl_6$, the titanium meshes were coated by repetition of brushing of the butanol solutions, drying at 90° C. for 5 min. and calcination for conversion to oxide at 550° C. for 10 min. until the weight of the oxide increased to 45 $g/m^2$. The electrodes were obtained by final calcination at 550° C. for 60 min. The cationic compositions of the electrocatalysts thus formed were determined by EPMA as shown in Table 1. X-ray diffraction identified that the electrocatalysts of the electrodes were composed of the single phase triple oxide with the same rutile structure as $IrO_2$.

Using the electrodes thus prepared as the anode, electrolysis was carried out in 3 M $H_2SO_4$ at 40° C. at current density of 10,000 $A/m^2$, and the anode potential was measured. The periods of time during which the overpotential of the anode was kept at about 0.6 V are shown in Table 1, in which the period of time for the comparative $IrO_2$ anode in Example 1 is also shown. It was clarified that the anodes of the present invention have better durability as the oxygen evolution anodes in the electrolysis of strong acid in comparison with the conventional dimensionally stable anode.

TABLE 1

| | | Butanol Solutions Mixed (ml) | | | Cationic % in Electrocatalyst | | | Life of Anode |
|---|---|---|---|---|---|---|---|---|
| | | $K_2IrCl_6$ | $SnCl_4$ | $SbCl_5$ | Ir | Sn | Sb | (h) |
| Examples | 1 | 0.50 | 8.46 | 1.04 | 13 | 70 | 17 | 600 |
| | 2 | 2.00 | 7.12 | 0.88 | 36 | 52 | 12 | 1270 |
| | 3 | 4.00 | 5.33 | 0.67 | 46 | 41 | 13 | 1410 |
| Control Example | | 10.00 | — | — | 100 | — | — | 450 |

When these anodes of the present invention were used for the electrolysis of chlorine evolution in 0.5 M NaCl solution at current density of 10,000 $A/m^2$, the chlorine evolution efficiencies were 81-87%.

Example 3

The same surface treatments as Example 1, i.e., removal of the surface film, etching for surface roughening, rinsing with water and ultrasonic rinsing, were applied to the punched titanium substrate meshes of the effective surface area of 20 $cm^2$.

5 M precious metal butanol solutions, i.e., 5 M $RuCl_3$, 5 M $RhCl_3$, 5 M $PdCl_3$, 5 M $OsCl_3$, 5 M $K_2IrCl_6$ and 5 M $K_2PtCl_6$ butanol solutions, were prepared. The solutions of the above 5 M precious metal butanol solutions, and the solutions of 5 M $SnCl_4$ and 5 M $SbCl_6$ also prepared as butanol solutions were mixed in various ratios to prepare mixed solutions. The titanium meshes were coated by repetition of brushing of the mixed solutions, drying at 90° C. for 5 min. and calcination for conversion to oxide at 550° C. for 10 min. until weight of the oxide increased to 45 $g/m^2$. The electrode were obtained by final calcination at 550° C. for 60 min. The cationic compositions of the electrocatalysts thus formed were determined by EPMA and are shown in Table 2. X-ray diffraction identified that the electrocatalysts of the electrodes were composed of the single phase multiple oxide with the same rutile structure as $IrO_2$.

Using the electrodes thus prepared as the anode, electrolysis was carried out in 3 M $H_2SO_4$ at 40° C. and at current density of 10,000 $A/m^2$, and the anode potential was measured. The anode overpotential was constantly about 0.6 V for a certain period of time in which oxygen was evolved, and then suddenly increased showing the end of the life of the anode. The periods of time during which the overpotential of the anode was kept at about 0.6 V are shown in Table 2. It was clarified that the anodes of the present invention have better durability as the oxygen evolution anodes in the electrolysis of strong acid than the conventional dimensionally stable anode.

TABLE 2

| | Cationic % in Electrocatalyst | | | | | | | | Life of Anode |
|---|---|---|---|---|---|---|---|---|---|
| No. | Ru | Rh | Pd | Os | Ir | Pt | Sn | Sb | (h) |
| 1 | 49 | | | | | | 42 | 9 | 1500 |
| 2 | 12 | | | | | | 78 | 10 | 490 |
| 3 | 98.5 | | | | | | 1 | 0.5 | 460 |
| 4 | | 99 | | | | | 0.6 | 0.4 | 460 |
| 5 | | 46 | | | | | 43 | 11 | 1400 |
| 6 | | 11 | | | | | 56 | 33 | 455 |
| 7 | | | 98 | | | | 1.5 | 0.5 | 465 |
| 8 | | | 95.1 | | | | 2.5 | 2.4 | 470 |
| 9 | | | 52 | | | | 31 | 17 | 1250 |
| 10 | | | 12 | | | | 59 | 29 | 460 |
| 11 | | | | 98.6 | | | 1.1 | 0.3 | 480 |
| 12 | | | | 51 | | | 31 | 18 | 1600 |
| 13 | | | | 11 | | | 64 | 25 | 500 |
| 14 | | | | | 95 | | 4 | 1 | 500 |
| 15 | | | | | 11 | | 84 | 5 | 510 |
| 16 | | | | | 11 | | 88 | 1 | 490 |
| 17 | | | | | | 97.7 | 1.2 | 1.1 | 505 |

TABLE 2-continued

| | Cationic % in Electrocatalyst | | | | | | | | Life of Anode |
|---|---|---|---|---|---|---|---|---|---|
| No. | Ru | Rh | Pd | Os | Ir | Pt | Sn | Sb | (h) |
| 18 | | | | | | 64 | 21 | 15 | 1810 |
| 19 | | | | | | 10.4 | 74 | 15.6 | 510 |

We claim:

1. An anode for electrochemical reactions comprising an electroconductive substrate made of titanium and electrocatalyst metal oxides covering the substrate; wherein the electrocatalyst metal oxides consist of the oxides of platinum group element(s) and the oxides of Sn and Sb, wherein the cationic ratio of Sn to Sb is 1-40, and wherein the sum of Sn and Sb shares up to 90 cationic % of the cationic substances.

2. The anode for electrochemical reactions according to claim 1, wherein the cationic % of the sum of Sn and Sb is 1-70.

* * * * *